US011738423B2

(12) United States Patent
Peng

(10) Patent No.: US 11,738,423 B2
(45) Date of Patent: Aug. 29, 2023

(54) CHEMICAL MECHANICAL POLISHING APPARATUS AND METHOD

(71) Applicant: TAIWAN SEMICONDUCTOR MANUFACTURING CO., LTD., Hsinchu (TW)

(72) Inventor: Cheng-Chin Peng, Hsinchu (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 1007 days.

(21) Appl. No.: 16/502,845

(22) Filed: Jul. 3, 2019

(65) Prior Publication Data

US 2020/0039028 A1 Feb. 6, 2020

Related U.S. Application Data

(60) Provisional application No. 62/712,378, filed on Jul. 31, 2018.

(51) Int. Cl.

| | |
|---|---|
| ***B24B 53/017*** | (2012.01) |
| ***B24B 37/04*** | (2012.01) |
| ***B24B 49/12*** | (2006.01) |
| ***B24B 49/18*** | (2006.01) |
| ***B24B 49/00*** | (2012.01) |
| ***B24B 37/22*** | (2012.01) |

(52) U.S. Cl.

CPC ..... *B24B 53/017* (2013.01); *B24B 37/042* (2013.01); *B24B 37/22* (2013.01); *B24B 49/003* (2013.01); *B24B 49/12* (2013.01); *B24B 49/186* (2013.01)

(58) Field of Classification Search

CPC ..... B24B 37/34; B24B 53/12; B24B 53/017; B24B 53/02; B24B 53/00; B24B 53/001; B24B 53/007

See application file for complete search history.

(56) References Cited

U.S. PATENT DOCUMENTS

| | | | | |
|---|---|---|---|---|
| 6,071,178 A * | 6/2000 | Baker, III | ..... | B24B 37/24 451/63 |
| 9,737,971 B2 | 8/2017 | Acholla et al. | | |
| 10,071,459 B2 | 9/2018 | Lugg et al. | | |

(Continued)

FOREIGN PATENT DOCUMENTS

| | | |
|---|---|---|
| CN | 201261164 Y | 6/2009 |
| CN | 106853610 A | 6/2017 |

(Continued)

*Primary Examiner* — Joel D Crandall

(74) *Attorney, Agent, or Firm* — Sterne, Kessler, Goldstein & Fox P.L.L.C.

(57) ABSTRACT

The present disclosure describes a method and apparatus to remove consumable (e.g., sacrificial) polishing pad layers from a multilayer polishing pad. For example, the method includes measuring a thickness profile of a top polishing pad layer of a multilayer polishing pad and comparing the thickness profile to a threshold. The method, in response to the thickness profile being above the threshold, rinses the top polishing pad layer of the multilayer polishing pad and removes, after the top polishing pad layer has been rinsed, the top polishing pad layer to expose an underlying polishing pad layer of the multilayer polishing pad.

20 Claims, 6 Drawing Sheets

(56) References Cited

U.S. PATENT DOCUMENTS

| | | | | |
|---|---|---|---|---|
| 2004/0214511 | A1* | 10/2004 | Bermann | B24B 53/017 451/41 |
| 2011/0143640 | A1* | 6/2011 | Bajaj | B23K 26/3576 451/449 |
| 2014/0206263 | A1* | 7/2014 | Bajaj | B24B 53/017 451/72 |
| 2014/0273752 | A1 | 9/2014 | Bajaj et al. | |

FOREIGN PATENT DOCUMENTS

| | | | | |
|---|---|---|---|---|
| JP | 2004017214 | A | * | 1/2004 |
| TW | 201446420 | A | | 12/2014 |
| TW | 201532731 | A | | 9/2015 |

* cited by examiner

CHEMICAL MECHANICAL POLISHING APPARATUS AND METHOD

CROSS-REFERENCE TO RELATED APPLICATION

This application claims the benefit of U.S. Provisional Patent Application No. 62/712,378, titled "Novel Chemical Mechanical Polishing Apparatus and Method," which was filed on Jul. 31, 2018 and is incorporated herein by reference in its entirety.

BACKGROUND

Polishing pad conditioners in wafer polishing equipment "re-energize" a polishing pad's surface and extend the polishing pad's lifetime by ensuring consistent chemical mechanical planarization (CMP) processes. However, the polishing performance of the polishing pad deteriorates over time even with the use of polishing pad conditioners. The gradual deterioration of the polishing pad's performance can lead to a polishing variation across wafers that have been polished between the beginning and the end of the polishing pad's lifetime.

BRIEF DESCRIPTION OF THE DRAWINGS

Aspects of the present disclosure are best understood from the following detailed description when read with the accompanying figures. It is noted that, in accordance with common practice in the industry, various features are not drawn to scale. In fact, the dimensions of the various features may be arbitrarily increased or reduced for clarity of discussion.

DETAILED DESCRIPTION

Figure 1:
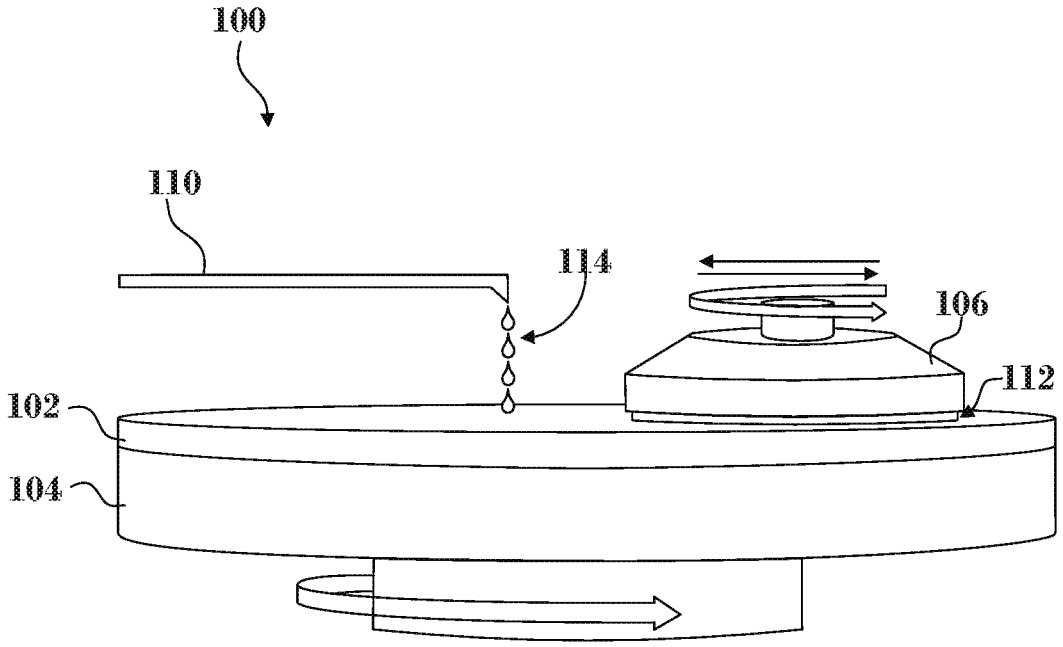
FIG. 1 is an isometric view of a polisher, according to some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over a second feature in the description that follows may include embodiments in which the first and second features are formed in direct contact, and may also include embodiments in which additional features may be formed that are between the first and second features, such that the first and second features are not in direct contact.

Further, spatially relative terms, such as "beneath," "below," "lower," "above," "upper," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The term "nominal" as used herein refers to a desired, or target, value of a characteristic or parameter for a component or a process operation, set during the design phase of a product or a process, together with a range of values above and/or below the desired value. The range of values is typically due to slight variations in manufacturing processes or tolerances.

The term "substantially" as used herein indicates the value of a given quantity that can vary based on a particular technology node associated with the subject semiconductor device. In some embodiments, based on the particular technology node, the term "substantially" can indicate a value of a given quantity that varies within, for example, ±5% of a target (or intended) value.

The term "about" as used herein indicates the value of a given quantity that can vary based on a particular technology node associated with the subject semiconductor device. In some embodiments, based on the particular technology node, the term "about" can indicate a value of a given quantity that varies within, for example, 5-30% of the value (e.g., ±5%, ±10%, ±20%, or ±30% of the value).

The term "vertical," as used herein, means nominally perpendicular to the surface of a substrate.

Chemical mechanical planarization (CMP) is a wafer surface planarization technique that planarizes the wafer's surface by relative motion between the wafer and a polishing pad in the presence of a slurry while applying pressure (downforce) to the wafer. The CMP tool is referred to as a "polisher." In the polisher, the wafer faces down on a wafer holder, or carrier. An opposite wafer surface is held against a polishing pad positioned on a flat surface (referred to as a "platen"). Polishers can use either a rotary or orbital motion during the polishing process. CMP achieves wafer planarity by removing elevated features on the wafer's surface relative to recessed features. The slurry and the polishing pad are referred to as "consumables" because of their continuous usage and replacement; their condition needs to be continuously monitored.

The slurry is a mixture of fine abrasive particles and chemicals that are used to remove specific materials from the wafer's surface during the CMP process. Precise slurry mixing and consistent batch blends are critical for achieving wafer to wafer (WtW) and lot to lot (LtL) polishing repeatability (e.g., consistent polishing rate, consistent polishing uniformity across the wafer and across the die, etc.). The quality of the slurry is important so that scratches on the wafer surface are prevented during the CMP process.

The polishing pad attaches to a top surface of the platen. The polishing pad can be made, for example, from polyurethane due to polyurethane's mechanical characteristics and porosity. Further, the polishing pad can feature small perforations (e.g., grooves) to help transport the slurry along the wafer's surface and promote uniform polishing. The polishing pad also removes the reacted products away from the wafer's surface. As the polishing pad is used to polish more wafers, the polishing pad's surface becomes flat and smooth, causing a condition referred to as "glazing." Glazed pads cannot hold the polishing slurry-which significantly decreases the polishing rate and polishing uniformity on the wafer.

Polishing pads require regular conditioning to retard the effects of glazing. The purpose of conditioning is to extend the polishing pad's lifetime and provide consistent polishing performance throughout its life. Pads can be conditioned with mechanical abrasion or a deionized (DI) water jet spray that can agitate (activate) the polishing pad's surface and increase its roughness. An alternative approach to activate the polishing pad's surface is to use a conditioning wheel ("disk") featuring a bottom diamond surface that contacts the polishing pad while it rotates. The conditioning process inevitably removes pad surface material and it is a significant factor in the polishing pad's lifetime. Conditioning can be performed either in-situ (internal) or ex-situ (external) of the CMP tool. In in-situ conditioning, the conditioning process is performed in real-time, where the polishing pad conditioning wheel or disk is applied to one portion of the polishing pad while the wafer polishing occurs on another portion of the polishing pad. In ex-situ pad conditioning, the conditioning is not performed during polishing but only after a predetermined number of wafers is polished. Eventually the polishing pad will have to be replaced. For example, 3000 or more wafers can be processed before the polishing pad is replaced.

Pad conditioning however has its challenges and it is not a straightforward process. For example, as the polishing pad is conditioned over its lifetime, the polishing pad's surface becomes increasingly uneven-more so at the edges of the polishing pad-due to inherent mechanical limitations (e.g., the size of the wheel or disk). Further, the polishing pad's surface can become uneven (e.g., non-planar) as it polishes an increasing number of wafers. Therefore, during conditioning, if the wheel exerts the same downforce to all the features of an uneven surface, the surface uniformity of the polishing pad will not improve over time. For instance, the uneven profile (e.g., surface contour) of the polishing pad's surface will propagate through the polishing pad's volume as pad material is removed from its surface during the conditioning process. Consequently, as the polishing pad is repeatedly conditioned, its polishing ability (removal rate) deteriorates through its lifetime. In other words, the polishing pad's lifetime and performance is impacted, which in turn increases the CMP cost and yield loss.

The present disclosure is directed to a method and apparatus that utilize a multiple layer ("multilayer") polishing pad and a laser unit configured to remove a non-planar top polishing pad layer of the multiple layer polishing pad as means to condition the multiple layer polishing pad, extend the polishing pad's lifetime, and provide a consistent wafer polishing performance throughout the polishing pad's lifetime. In some embodiments, the laser unit is configured to produce a laser with a wavelength range between about 400 nm and about 700 nm (e.g., about 532 nm). In other embodiments, the laser beam is configured to burn the top polishing pad layer of the multilayer polishing pad to reveal an unused (or fresh) under-layer. The fresh layer can be substantially planar compared to the removed layer and can thus reset the polishing rate and polishing uniformity of the CMP process.

FIG. 1 is an isometric view of selected components of an exemplary CMP polisher 100 (also referred to herein as "polisher 100"), according to some embodiments. Polisher 100 includes a polishing pad 102 (also referred to herein as "pad 102") which is loaded on a rotating platen (e.g., a rotating table) 104. Polisher 100 also includes a rotating wafer carrier 106 and a slurry feeder 110. For illustration purposes, FIG. 1 includes selected portions of polisher 100 and other portions (not shown) may be included, such as chemical delivery lines, drain lines, control units, transfer modules, pumps, etc. A wafer 112 to be polished is mounted face-down (e.g., with its top surface facing down) at the bottom of wafer carrier 106 so that the wafer's top surface contacts the top surface of pad 102. Wafer carrier 106 rotates wafer 112 and exerts pressure (e.g., downforce) on it so that wafer 112 is pressed against rotating pad 102. Slurry 114, which includes chemicals and abrasive particles, is dispensed on the polishing pad's surface. Chemical reactions and mechanical abrasion between slurry 114, wafer 112, and pad 102 can result in material removal from the top surface of wafer 112.

In some embodiments, platen 104 and wafer carrier 106 rotate in the same direction (e.g., clockwise or counter clockwise) but with different angular speeds (e.g., rotating speeds). At the same time, wafer carrier 106 can swing between the center and the edge of pad 102. However, the aforementioned relative movements of the various rotating components, such a wafer carrier 106 and platen 104, are not limiting.

In some embodiments, the physical and mechanical properties of pad 102 (e.g., roughness, material selection, porosity, stiffness, etc.) depend on the material to be removed from wafer 112. For example, copper polishing, copper barrier polishing, tungsten polishing, shallow trench isolation polishing, oxide polishing, or buff polishing require different types of pads in terms of materials, porosity, and stiffness. The polishing pads used in a polisher (e.g., polisher 100) should exhibit some rigidity in order to uniformly polish the wafer surface. Polishing pads (e.g., pad 102) can be a stack of soft and hard materials that can conform to some extent to the local topography of wafer 112. By way of example and not limitation, pad 102 can include porous polymeric materials with a pore size between about 1 μm and about 500 μm.

Figure 2:
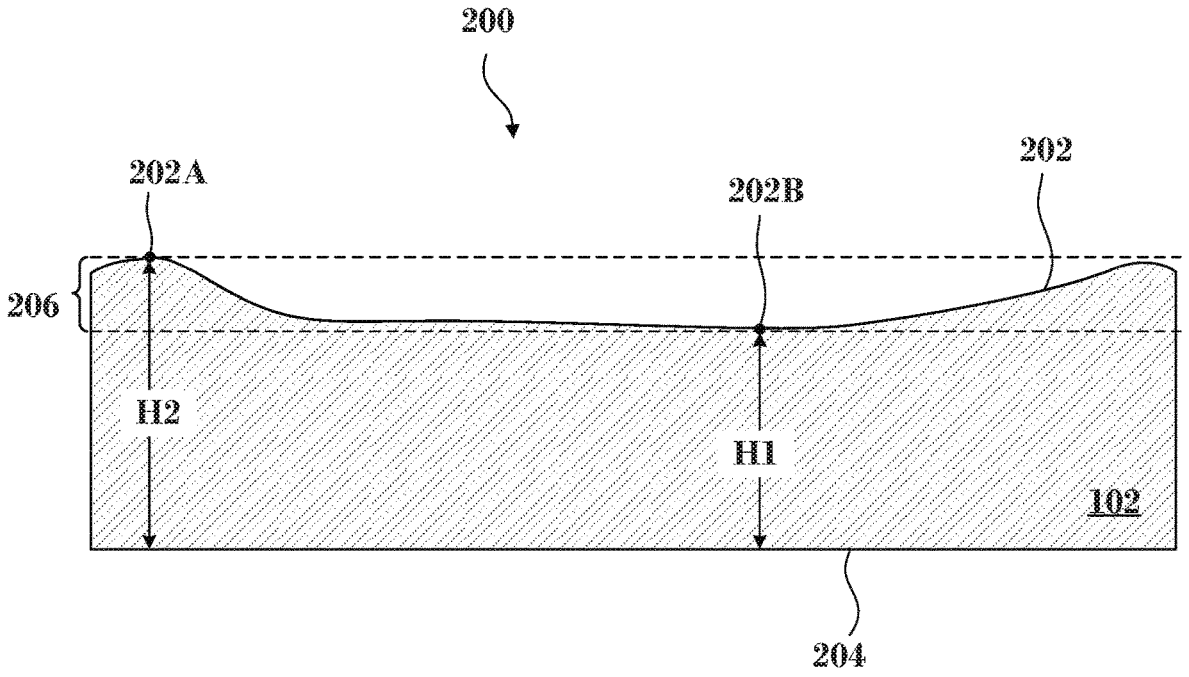
FIG. 2 is a cross-sectional view of a polishing pad, according to some embodiments.

According to some embodiments, FIG. 2 is a magnified, cross-sectional view 200 of an exemplary "used" pad 102 (also shown in FIG. 1). A thickness profile 206 of pad 102 can be the result of the continuous polishing action of pad 102 on wafers (e.g., wafer 112). In some embodiments, the height difference between a "high" point 202A and a "low" point 202B on the polishing pad's top surface 202 can be as much as 0.1 mm (e.g., $H2-H1 \leq 0.05$ mm). The height of each point (e.g., "high" point 202A and "low" point 202B) on top surface 202 is measured in reference to the polishing pad's substantially planar bottom surface 204, as shown in FIG. 2. If pad 102 continues to polish wafer 112, thickness profile 206 of pad 102 will become more pronounced. For example, the height difference between high point A and low point B will increase. As a result of this process, polishing pad 102 will lose its polishing ability and it will produce poor uniformity across wafer 112.

Figure 3:
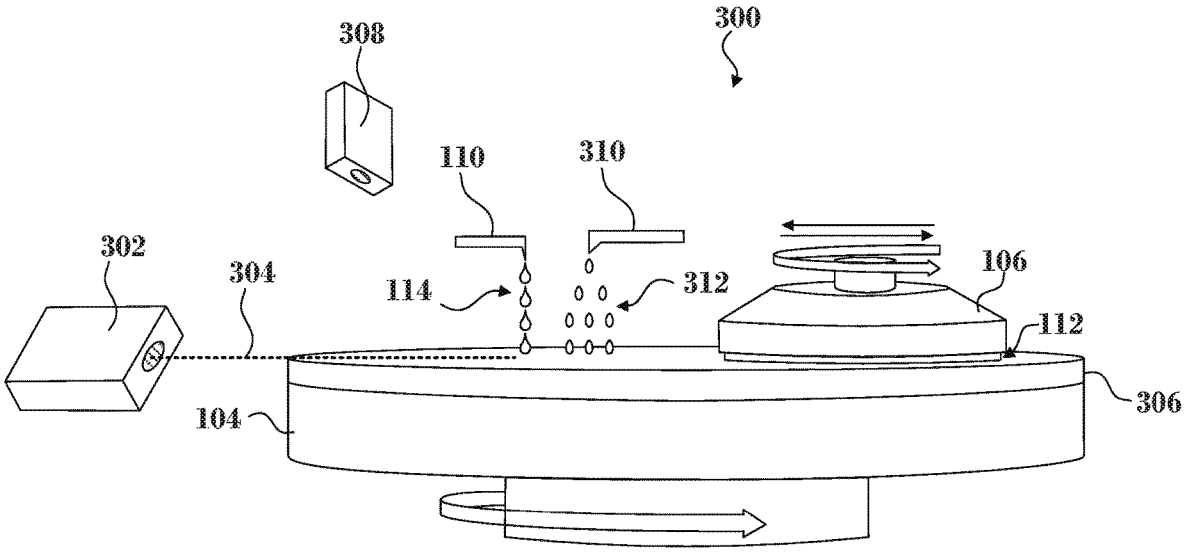
FIG. 3 is an isometric view of a polisher that includes a laser unit and a multilayer polishing pad, according to some embodiments.

FIG. 3 is an isometric view of selective components of an exemplary CMP polisher 300 (also referred to herein as "polisher 300"), according to some embodiments. Polisher 300 includes a multilayer polishing pad 306 on a rotating platen 104, a rotating wafer carrier 106, and a slurry feeder 110. Further, polisher 300 is equipped with a laser unit 302. In some embodiments, laser unit 302 is configured to produce a laser beam 304 capable of removing a top layer of multilayer polishing pad 306. Laser beam 304 has a wavelength between about 400 nm and 700 nm. More specifically, the wavelength of laser beam 304 can range between the ultraviolet and the infrared spectrums. In some embodiments, laser beam 304 produced by laser unit 302, is substantially parallel to the surface of multilayer polishing pad 306, as shown in FIG. 3. In some embodiments, laser beam 304 scans the surface of multilayer polishing pad 306, while multilayer polishing pad 306 rotates. As a result, laser beam 304 removes the non-planar layer (e.g., top layer) of multilayer polishing pad 306 and reveals an unused (or fresh) substantially flat under-layer.

In some embodiments, multilayer polishing pad 306 includes 4 or more individual polishing pad layers (e.g., 4, 6, 10, or more) made from a polymer material. By way of example and not limitation, laser beam 304 can remove the top polishing pad layer of the multilayer polishing pad 306 when the surface uniformity of the top polishing pad layer is not acceptable—for example, when the removal rate for polishing materials on wafer 112 drops below an allowable level or when the CMP non-uniformity on wafer 112 increases beyond acceptable levels. In some embodiments, a sensor 308, which can be located over multilayer polishing pad 306, is configured to monitor the thickness of the top polishing pad layer of multilayer polishing pad 306 and to indicate to a system (not shown in FIG. 3) when the top polishing pad layer of multilayer polishing pad 306 needs to be removed by laser unit 302. By way of example and not limitation, sensor 308 can be an optical sensor (e.g., a camera, a laser, an infrared (IR) sensor, etc.) or an acoustic sensor (e.g., ultrasound sensor). In some embodiments, sensor 308 is configured to be stationary with respect to the position of multilayer polishing pad 306 or to move along a plane parallel to multilayer polishing pad 306 at a fixed height from the top surface of multilayer polishing pad 306 or platen 104.

As discussed above, multilayer polishing pad 306 includes multiple polishing pad layers. For example, and referring to FIG. 4, multilayer polishing pad 306 can include individual polishing pad layers 306A, 306B, 306C, and 306D arranged on top of each other with a separation layer 400 between adjacent polishing pad layers. The number of layers in multilayer polishing pad 306 may not be limited to the example of FIG. 4, and thus multilayer polishing pad 306 can include fewer or additional individual polishing pad layers. In some embodiments, multilayer polishing pad 306 can include from 4 to 10 or more individual polishing pad layers (e.g., 4, 6, 8, 10, or 15). By way of example and not limitation, the polishing pads layers in multilayer polishing pad 306 share a common diameter D that can range from about 20 inches to about 32 inches, according to some embodiments. Further, thickness T of each polishing pad layer can range from about 20 mil (e.g., about 0.508 mm) to about 25 mil (e.g., about 0.635 mm), where 1 mil is equal to 0.001 inches or 0.0254 mm. By way of example and not limitation, the total thickness of multilayer polishing pad 306 can range between about 80 mil and about 120 mil. Therefore, depending on the thickness of each polishing pad layer, the multilayer polishing pad can include four or more sacrificial polishing pad layers (e.g., layers 306A, 306B, 306C, and 306D).

According to some embodiments, each polishing pad layer (e.g., 306A, 306B, 306C, and 306D) is a disc made of a polymer with a grooved top surface (not shown in FIG. 4), which helps transport the polishing slurry along the wafer's surface and promotes uniform polishing. Additionally, the polishing pad layers can be porous or solid, hard or soft, depending on the application. By way of example and not limitation, the polishing pad layers can be used to polish metals, dielectrics, glass, ceramics, plastics, etc.

Figure 4:
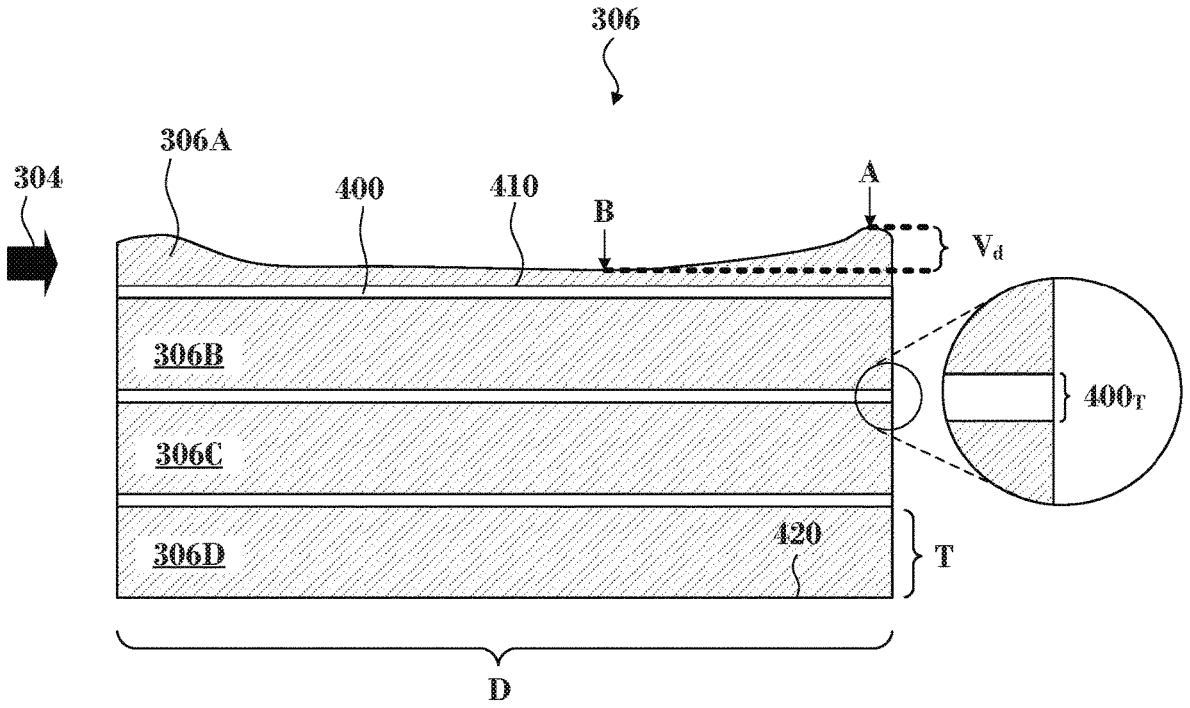
FIG. 4 is a cross-sectional view of a multilayer polishing pad with a top polishing pad layer having a non-uniform thickness profile, according to some embodiments.

In some embodiments, in referring to FIG. 4, separation layer 400 has a thickness $\mathbf{400}_T$ that ranges from about 0.2 mm to about 0.5 mm (e.g., about 0.2 mm). By way of example and not limitation, separation layer 400 is also a disc with a diameter D (e.g., substantially equal to sacrificial polishing pad layers 306A, 306B, 306C, and 306D). In some embodiments, separation 400 is a glue layer or a bonding layer that holds the sacrificial polishing pad layers together. By way of example and not limitation, separation layer 400 can be made of a polymer material. According to some embodiments, laser beam 304 removes separation layer 400 faster than sacrificial polishing pad layers 306A, 306B, 306C, and 306D. For example, laser beam 304 can remove separation layer 400 about 10 times faster than the sacrificial polishing pad layers of multilayer polishing pad 306.

In some embodiments, top polishing pad layer 306A of multilayer polishing pad 306 develops a non-planar (e.g., a non-uniform) thickness profile due to its continuous polishing action on wafer 112 shown in FIG. 3. As a result, the polishing rate of top polishing pad layer 306A decreases, and the polishing uniformity achieved on polished wafer 112 gradually deteriorates. The non-planar, or non-uniform, thickness profile starts to appear when points on the surface of top polishing pad layer 306A develop an elevation difference (e.g., a vertical distance difference) measured from a common reference point. When the vertical distance between two points on the surface of top polishing pad layer 306A exceeds a limit (e.g., a threshold), the resulting thickness uniformity becomes substantial to the extent it impacts the polishing performance of top polishing pad layer 306A. In some embodiments, and referring to FIG. 4, the uniformity of the thickness profile of top polishing pad layer 306A can be determined by vertical distance $V_d$ between point A and point B on the surface of top polishing pad layer 306A. In some embodiments, point A and point B are respectively the highest and lowest points among all surface points on top polishing pad layer 306A. In other words, point A is a "global" high surface point, and point B is a "global" low surface point. By way of example or limitation, the height or the elevation of each surface point on top polishing pad layer 306A can be measured from a common reference point—for example, from the bottom surface of the top polishing pad layer, from the bottom surface of the multi-layer polishing pad, or form another reference point. For example, the height, or elevation, of surface points A and B in FIG. 4 can be measured either from bottom surface 410 of top polishing pad layer 306A, from bottom surface 420 of multilayer polishing pad 306, or from another suitable reference point.

In some embodiments, the thickness non-uniformity of top polishing pad layer 306A is determined by a vertical distance $V_d$ between global high surface point A and global low surface point B. In some embodiments, the vertical distance $V_d$ between global high surface point A and global low surface point B is the maximum vertical distance between any two surface points on top polishing pad layer 306A.

Figure 5:
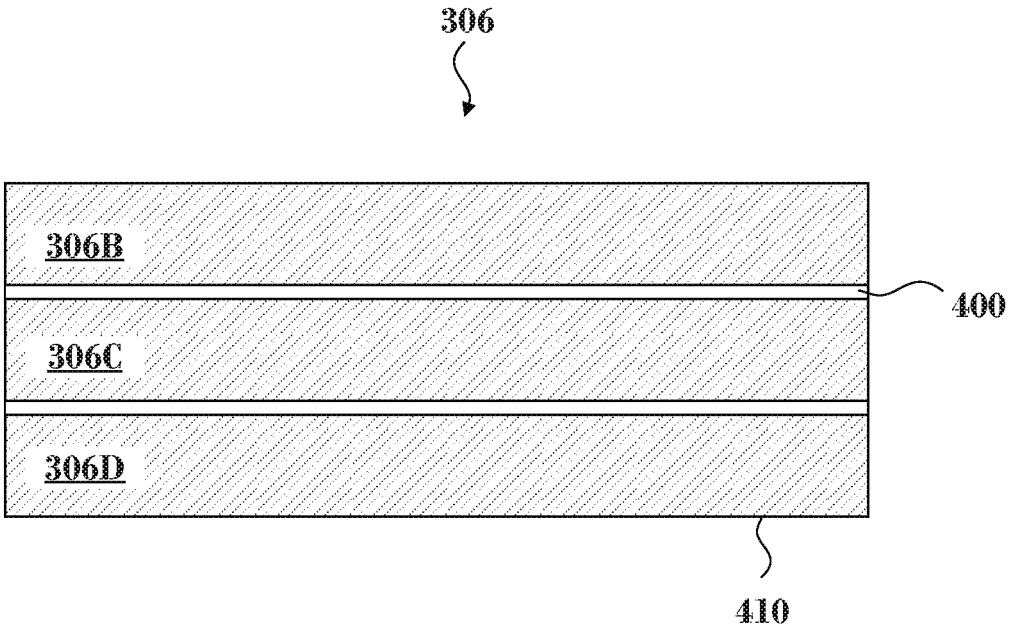
FIG. 5 is a cross-sectional view of a multilayer polishing pad with a top polishing pad layer having a substantially planar thickness profile, according to some embodiments.

When the polishing uniformity achieved on wafer 112 is no longer within an acceptable range, top polishing pad layer 306A can be removed to reveal a substantially planar underlying polishing pad layer 306B. In some embodiments, removal of top polishing pad layer 306A is achieved with laser beam 304 (shown in FIGS. 3 and 4) produced by laser unit 302 (shown in FIG. 3). For example, and referring to FIG. 4, laser beam 304 can remove the non-planar top polishing pad layer 306A and separation layer 400 to reveal underlying polishing pad layer 306B, as shown in FIG. 5. In some embodiments, underlying layer 306B is a "fresh" layer that has a substantially planar top surface. Therefore, the polishing capability of multilayer polishing pad 306 can be restored in terms of polishing rate and polishing uniformity on wafer 112. According to some embodiments, removal of top polishing pad layer 306A means that top polishing pad layer 306A and separation layer 400 can be "burned-off" or trimmed by laser beam 304. The result of the aforementioned removal operation is shown in FIG. 5.

Over time, the top surface of polishing pad layer 306B will also become non-uniform. At that point, laser beam 304 can be used to remove polishing pad layer 306B and separation layer 400 to expose a fresh polishing pad layer 306C. This process can be repeated until the last polishing pad layer (e.g., polishing pad layer 306D) is exposed and used in wafer polishing. When polishing pad layer 306D is consumed and its top surface becomes non-planar, multilayer polishing pad 306 can be discarded and replaced with a new multilayer polishing pad.

Figure 6:
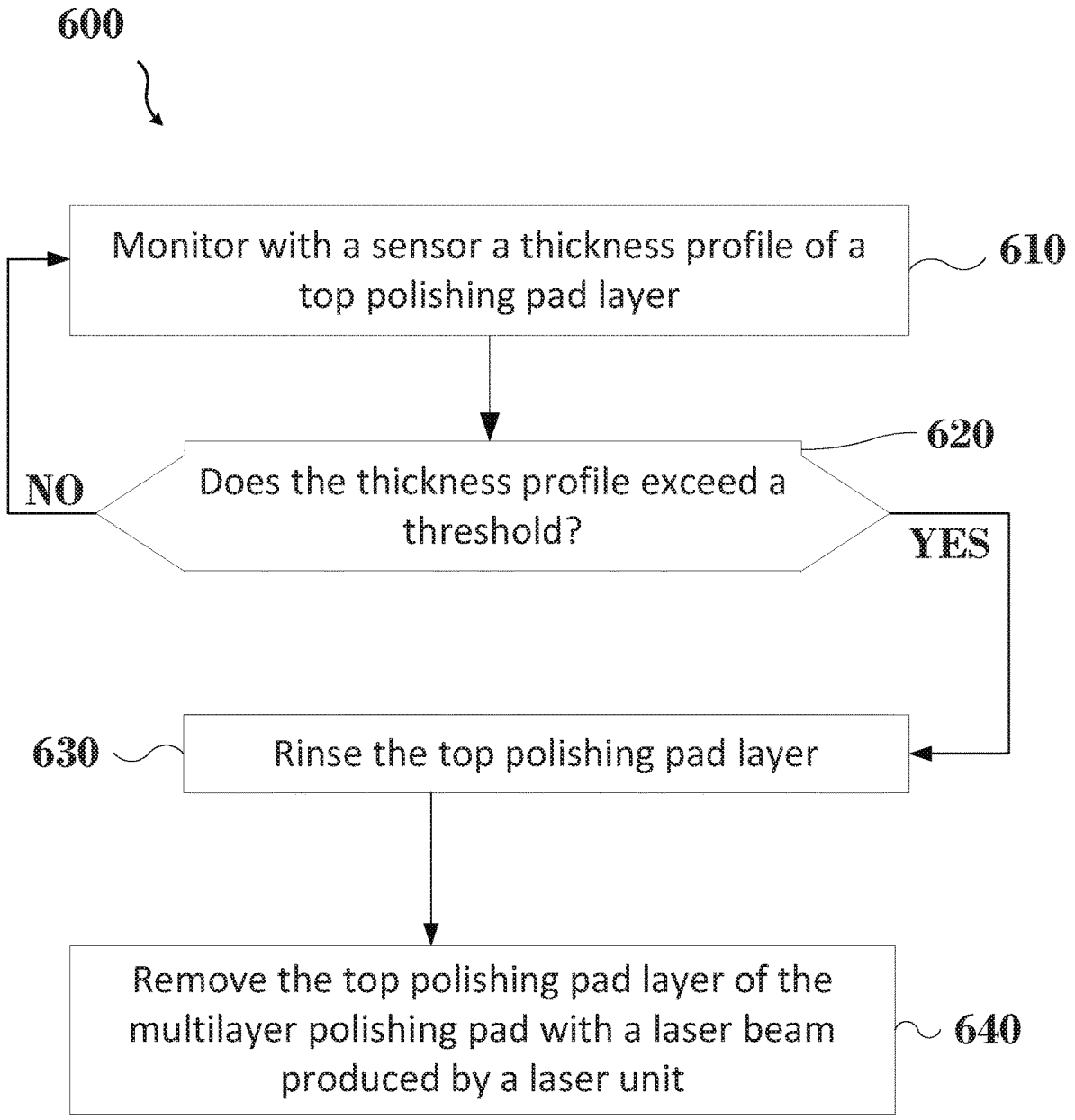
FIG. 6 is a flow chart of a method for removing a top polishing pad layer from a multilayer polishing pad, according to some embodiments.

FIG. 6 is an exemplary method 600 for removing a polishing pad layer of a multilayer polishing pad with a laser beam, according to some embodiments. This disclosure is not limited to this operational description. It is to be appreciated that additional operations may be performed. Moreover, not all operations may be needed to perform the disclosure provided herein. Further, some of the operations may be performed simultaneously, or in a different order than shown in FIG. 6. In some implementations, one or more other operations may be performed in addition to or in place of the presently described operations. For illustration purposes, method 600 is described with reference to the embodiments of FIGS. 3-5. However, method 600 is not limited to these embodiments.

In some embodiments, a system, not shown in FIGS. 3-5, is configured to perform the operations of method 600 and to coordinate the operation of sensor 308, laser unit 302, nozzle 310, and other components of polisher 300. By way of example and not limitation, the system can include one or more computer units with appropriate software and hardware, controllers, wireless or wired communication units, and other electronic equipment.

Exemplary method 600 begins with operation 610, where a sensor (e.g., sensor 308 shown in FIG. 3) monitors the thickness profile of a polishing pad layer in a multilayer polishing pad. According to some embodiments, the polishing pad layer can be top polishing pad layer 306A of a multilayer polishing pad 306 shown in FIG. 4. In some embodiments, the thickness profile of top polishing pad layer 306A is monitored by measuring with sensor 308 the elevation (e.g., the height) of a fixed number of surface points (e.g., 5, 10, 15, 20, 30, 50, 60, or more) on top polishing pad layer 306A, and calculating a height difference (e.g., a vertical distance $V_d$) between pairs of the measured surface points. As discussed above, the height measurement or elevation measurement of each surface point is taken with respect to a common reference point or location such as bottom surface 410 of top polishing layer 306A, bottom surface 420 of multilayer polishing pad 306, or another suitable reference point or location. The maximum vertical distance $V_d$ between any two surface points on top polishing pad layer 306A corresponds to the vertical distance between a global high surface point (e.g., the point A) and a global low surface point (e.g., the point B) shown in FIG. 4. In some embodiments, the vertical distance $V_d$ between a global high surface point and a global low surface point correlates to the thickness non-uniformity of top polishing pad layer 306A. For example, the larger the vertical distance $V_d$ between a global high surface point and a global low surface point, the larger the thickness non-uniformity of top polishing pad layer 306A. In some embodiments, the thickness profile of top polishing pad layer 306A correlates to the polishing pad's "polishing performance." For example, the polishing performance of the top polishing pad layer 306A deteriorates as the thickness profile of the top polishing pad layer 306A becomes less uniform.

In some embodiments, sensor 308 is configured to measure vertical distances between pairs of surface points in the range of about 0.051 mm and 0.254 mm.

In some embodiments, the larger the number of measured points by sensor 308, the more accurate the assessment on the thickness profile of the top polishing pad layer. However, the number of measured points needs to be balanced between accuracy and measurement efficiency, so that the measurement does not impact the polisher's throughput. In some embodiments, the duration of the measurement ranges from about 20 s to about 70 s (e.g., about 60 s). By way of example and not limitation, the measurement frequency can be adjusted. For example, the measurement can be performed prior or after each polishing operation, after a certain number of wafers have been polished (e.g., after 2, after 5, after 10, after 25, after 50, after 100, after 1000 wafers, etc.), in real-time during the wafer polishing operation, or at any desirable frequency.

Further, as discussed above, sensor 308 can be stationary with respect to the position of the polishing pad or it can be configured to move along a plane parallel to multilayer polishing pad 306 or platen 104 so that it can hover over the polishing pad and scan the surface of the top polishing pad layer. In some embodiments, during the measurement by sensor 308, the polishing pad 306 is stationary. In some embodiments, during the measurement by sensor 308, polishing pad 306 rotates continuously or in intervals.

In some embodiments, sensor 308 can include circuitry (e.g., a computational unit), which is configured to perform the vertical distance calculation between pairs of surface points on top polishing pad layer 306A and to determine the thickness profile uniformity of top polishing pad layer 306A. As discussed above, the sensor 308 can be part of a system that includes additional electronic equipment (e.g., control units, computers, wireless or wired communication units, etc.) and/or moving parts (e.g., arms, motors, etc.) responsible for the sensor's operation and movement. In some embodiments, the aforementioned system is configured to control the operation of sensor 308, laser unit 302, nozzle 310, and other components of polisher 300.

In some embodiments, the sensor 308 is an optical sensor (e.g., a camera, a laser, an infrared (IR) sensor, etc.), an acoustic wave sensor (e.g., ultrasound sensor), or combinations thereof. In some embodiments, polisher 300 is equipped with multiple types of sensors, or multiple sensors of the same type.

In some embodiments, the vertical distance $V_d$ between a global high surface point A and a global low surface point B on top polishing pad layer 306A measured by sensor 308 is compared to a "threshold." The "threshold," as described herein, is a vertical distance value—between a global high surface point and a global low surface point on top polishing pad layer 306A—above which, top polishing pad layer 306A demonstrates unacceptable polishing performance. In some embodiments, the threshold is about 0.051 mm. For a vertical distance $V_d$ that exceeds the threshold, top polishing pad layer 306A is considered consumed, or at the end of its lifetime, and needs to be replaced. The correlation between the threshold and the polishing pad's polishing performance can be determined, for example, through experimentation and further correlation with additional wafer metrics, such as yield data, electrical data, physical data, or combinations thereof.

Referring to FIG. 6, method 600 continues with operation 620, where the system determines whether the thickness profile exceeds the threshold. If the system determines that the thickness profile—for example, the vertical distance $V_d$ between high global surface point A and low global surface point B shown in FIG. 4—is below the threshold, then operation 620 proceeds to operation 610, where the system, via sensor 308, continues to monitor the thickness profile of top polishing pad layer 306A. In response to the vertical distance $V_d$ being above the threshold, then method 600 continues to operation 630.

In operation 630, the top polishing pad layer 306A is rinsed. In some embodiments, the rinsing removes byproducts produced during polishing (e.g., slurry or other abrasives, polishing material from wafer 112, etc.) from the surface of the top polishing pad layer 306A. Further, the rinse prepares the top polishing pad layer 306A for removal. By way of example and not limitation, and in referring to FIG. 3, the rinse operation is provided by nozzle 310, which dispenses pressurized deionized (DI) water 312 (or other chemicals) on the surface of multilayer polishing pad 306. In some embodiments, the rinsing can be performed while multilayer polishing pad 306 rotates or when multilayer polishing pad 306 is stationary. In other embodiments, rinsing multilayer polishing pad 306 can be performed by more than one nozzle. For example, a plurality of nozzles, like nozzle 310, can be arranged around and/or over polishing pad 306.

Referring to FIG. 6 and operation 640, the top polishing pad layer 306A shown in FIG. 4 is removed by laser beam 304. In some embodiments, laser unit 302 is configured to produce a laser beam 304 with a beam size up to about 3 mm to ensure that a single polishing pad layer is removed. In comparison, a laser beam diameter larger than 3 mm is considered large compared to thickness T of the remaining polishing pad layer (e.g., less than about 0.508 mm or less than about 0.635 mm) and can make the removal process challenging to control. For example, laser beam 304 with a diameter larger than 3 mm can remove more than the remaining portion of top layer 306A (e.g., laser beam 304 can remove portions of underlying layer 306B). In some embodiments, laser beam 304 produced by laser unit 302 has a wavelength that ranges from about 400 nm to about 700 nm (e.g., about 532 nm). According to some embodiments, laser unit 302 produces between about 300 Watts and about 800 Watts of power across all the operating wavelengths (e.g., between about 400 nm and about 700 nm).

Removal of the polishing pad layer is achieved by burning off material from polishing pad layer 306A. In some embodiments, the removal rate of separation layer 400 is higher than the removal rate of the polishing pad layer to ensure that the underlying polishing pad layer 306B is free from traces (e.g., residue) of separation layer 400 when exposed. As discussed above, laser beam 304 removes separation layer 400 about 10 times faster than the polishing pad layer. In some embodiments, FIG. 5 shows multilayer polishing pad 306 after operation 630. As shown in FIG. 5, fresh polishing pad layer 306B is now exposed and can be used to polish subsequent wafers.

In some embodiments, the removal process of operation 630 is timed based on the vertical distance $V_d$ between a global high surface point A and a global low surface point B of top polishing pad layer 306A shown in FIG. 4. In some embodiments, the removal process is interrupted at predetermined intervals so that sensor 308 can re-measure the vertical distance $V_d$ between a global high surface point A and a global low surface point B of top polishing pad layer 306A. By way of example and not limitation, top polishing pad layer 306A is removed when the vertical distance $V_d$ between a global high point A and a global low point B, as measured by sensor 308, has reached a value that corresponds to a fresh polishing pad layer (e.g., substantially equal to or greater than about 80 mil), such as polishing pad layer 306B shown in FIG. 5.

Method 600 can be used until bottom polishing pad layer 306D is consumed; at that point, multilayer polishing pad 306 can be replaced with another multilayer polishing pad. According to some embodiments, method 600 achieves a consistent polishing performance compared to single-layer polishing pads, which require frequent conditioning with conditioning wheels or disks. Further, method 600 can be tuned so that the threshold is set to a value that balances polishing performance and polishing pad lifetime. For example, for critical polishing processes (e.g., polishing processes that are sensitive to wafer polishing variability) the threshold value of method 600 can be set so that the polishing pad layers are removed more frequently to maintain a more consistent polishing performance. Accordingly, for less critical polishing processes (e.g., polishing processes that can tolerate higher wafer polishing variability), the threshold value of method 600 can be set so that the polishing pad layers are removed less frequently and their lifetime is extended. In some embodiments, the threshold can be different for polishing pad layers with different hardness. For example, hard polishing pad layers may have a higher or lower threshold than soft polishing pad layers.

The present disclose is directed to a method and apparatus to remove consumable (e.g., sacrificial) polishing pad layers from a multilayer polishing pad. In some embodiments, the polishing pad removal can be performed by a laser unit configured to produce a laser beam having a wavelength that ranges, for example, from about 400 nm to about 700 nm and a beam diameter less than about 3 mm. In some embodiments, the multilayer polishing pad is a stack that includes 4 or more individual polishing pad layers, which can be individually removed by the laser beam. In other embodiments, the laser beam removes the top polishing pad layer (e.g., when the thickness profile of the layer is deemed unacceptable) to reveal an unused (or fresh) polishing pad layer, which can be used to polish subsequent wafers. The fresh polishing pad layer is substantially planar compared to the removed polishing pad layer, thus improving the polishing rate and uniformity of the CMP process.

In some embodiments, a system, includes a polishing pad with a plurality of polishing pad layers, a sensor configured to measure a thickness profile of a top polishing pad layer of the plurality of polishing pad layers, a rinse system configured to rinse a surface of the top polishing pad layer, and a laser unit configured to produce a laser beam to remove the top polishing pad layer.

In some embodiments, a method includes measuring a thickness profile of a top polishing pad layer of a multilayer polishing pad and comparing the thickness profile to a threshold. The method, in response to the thickness profile being above the threshold, rinses the top polishing pad layer of the multilayer polishing pad and removes, after the top polishing pad layer is rinsed, the top polishing pad layer to expose an underlying polishing pad layer of the multilayer polishing pad.

In some embodiments, a system includes a polisher with a multilayer polishing pad, one or more sensors configured to determine a thickness profile of a top polishing pad layer of the multilayer polishing pad, a rinse system configured to rinse the top layer of the multilayer polishing pad, and a laser unit configured to produce a laser beam to remove the top polishing pad layer from the multilayer polishing pad. The system further includes a computer unit configured to compare the thickness profile obtained by the one or more sensors to a value, and in response to the thickness profile being greater than the value, command the laser unit to remove the top polishing pad layer.

It is to be appreciated that the Detailed Description section, and not the Abstract of the Disclosure section, is intended to be used to interpret the claims. The Abstract of the Disclosure section may set forth one or more but not all possible embodiments of the present disclosure as contemplated by the inventor(s), and thus, are not intended to limit the subjoined claims in any way.

The foregoing disclosure outlines features of several embodiments so that those skilled in the art may better understand the aspects of the present disclosure. Those skilled in the art will appreciate that they may readily use the present disclosure as a basis for designing or modifying other processes and structures for carrying out the same purposes and/or achieving the same advantages of the embodiments introduced herein. Those skilled in the art will also realize that such equivalent constructions do not depart from the spirit and scope of the present disclosure, and that they may make various changes, substitutions, and alterations herein without departing from the spirit and scope of the present disclosure.

What is claimed is:

1. A system, comprising:

a polishing pad comprising a plurality of polishing pad layers;

a sensor configured to measure a thickness profile of a top polishing pad layer of the plurality of polishing pad layers;

a rinse system configured to rinse a surface of the top polishing pad layer; and a laser unit configured to produce a laser beam to remove the top polishing pad layer.

2. The system of claim 1, further comprising:

a wafer carrier configured to hold a wafer against the top polishing pad layer; and a slurry feeder configured to dispense a slurry on the top polishing pad layer.

3. The system of claim 1, wherein the polishing pad further comprises an intermediate layer between each of the plurality of polishing pad layers.

4. The system of claim 1, wherein each of the plurality of polishing pad layers has a thickness that ranges from about 20 mil to about 25 mil.

5. The system of claim 1, wherein the sensor comprises an optical sensor, an acoustic sensor, or combinations thereof.

6. The system of claim 1, wherein the laser beam comprises a wavelength that ranges from about 400 nm to about 700 nm and has a diameter less than about 3 mm.

7. The system of claim 1, wherein the sensor is arranged above the top polishing pad layer.

8. The system of claim 1, wherein the rinse system is configured to deliver pressurized deionized water to a surface of the top polishing pad layer.

9. A method, comprising:

measuring a thickness profile comprising two points of a top polishing pad layer of a multilayer polishing pad;

comparing the thickness profile to a threshold;

in response to the thickness profile being above the threshold, rinsing the top polishing pad layer of the multilayer polishing pad; and removing, after the top polishing pad layer is rinsed, the top polishing pad layer to expose an underlying polishing pad layer of the multilayer polishing pad.

10. The method of claim 9, further comprising:

in response to the thickness profile being equal to or below the threshold, polishing one or more wafers with the top polishing pad layer.

11. The method of claim 9, further comprising:

after removing the top polishing pad layer, polishing one or more wafers with the underlying polishing pad layer.

12. The method of claim 9, wherein measuring the thickness profile comprising the two points of the top polishing pad layer comprises measuring a maximum vertical distance between the two points on a surface of the top polishing pad layer.

13. The method of claim 9, wherein a total thickness of the top polishing pad layer and the underlying polishing pad layer of the multilayer polishing pad ranges from about 20 mil to about 25 mil.

14. The method of claim 9, wherein removing the top polishing pad layer comprises burning off material from the top polishing pad layer and a separation layer disposed between the top polishing pad layer and the underlying polishing pad layer.

15. The method of claim 14, wherein burning off the material from the top polishing pad layer comprises applying a laser beam, with a wavelength ranging from about 400 nm to about 700 nm and a diameter less than about 3 mm, to a surface of the top polishing pad layer.

16. The method of claim 9, wherein the multilayer polishing pad comprises stacked polishing pad layers with separation layers therebetween.

17. A system, comprising:

a polisher with a multilayer polishing pad;

one or more sensors configured to determine a thickness profile of a top polishing pad layer of the multilayer polishing pad;

a rinse system configured to rinse the top polishing pad layer of the multilayer polishing pad;

a laser unit configured to produce a laser beam to remove the top polishing pad layer from the multilayer polishing pad; and a computer unit configured to compare the thickness profile obtained by the one or more sensors to a value, and in response to the thickness profile being greater than the value, command the laser unit to remove the top polishing pad layer.

18. The system of claim 17, wherein the multilayer polishing pad further comprises a separation layer interposed between adjacent polishing pad layers.

19. The system of claim 17, wherein the laser beam is configured to be perpendicular to a side surface of the multilayer polishing pad.

20. The system of claim 17, wherein the one or more sensors are further configured to measure a maximum vertical distance between two surface points on the top polishing pad layer.

* * * * *